US005252097A

United States Patent [19]

Lindeberg et al.

[11] Patent Number: 5,252,097

[45] Date of Patent: Oct. 12, 1993

[54] FEMALE CONNECTOR WITH DUAL BEAM CONTACTS

[75] Inventors: Sven E. Lindeberg, Houilles; Claude Cassee, Clevilliers, both of France

[73] Assignee: Thomas & Betts Corporation, Bridgewater, N.J.

[21] Appl. No.: 876,559

[22] Filed: Apr. 30, 1992

[51] Int. Cl.[5] ..... H01R 11/22

[52] U.S. Cl. ..... 439/856; 439/842

[58] Field of Search ..... 439/743-747, 439/751, 851-857, 861, 862, 842, 843, 636

[56] References Cited

U.S. PATENT DOCUMENTS

| | | | |
|---|---|---|---|
| 3,362,008 | 1/1968 | Berg | 439/851 |
| 3,609,633 | 9/1971 | Hargett | 339/17 |
| 3,862,792 | 1/1975 | Jayne | 439/851 |
| 3,874,769 | 4/1975 | Simon | 439/857 |
| 3,977,752 | 8/1976 | Freitag | 339/95 |
| 4,018,492 | 4/1977 | Eckart | 339/14 |
| 4,379,611 | 4/1983 | Foege et al. | 439/747 |
| 4,408,824 | 10/1983 | Weidler | 439/857 |
| 4,480,386 | 11/1984 | Adams | 439/857 |
| 4,676,579 | 6/1987 | Ting | 439/825 |
| 4,834,681 | 5/1989 | Chaillot | 439/856 |
| 4,842,536 | 6/1989 | Meyrat et al. | 439/246 |
| 4,929,197 | 5/1990 | Finney | 439/861 |

*Primary Examiner*—David L. Pirlot

*Attorney, Agent, or Firm*—Robert M. Rodrick; Salvatore J. Abbruzzese

[57] ABSTRACT

A connector of the unitary type with dual-beam contacts is adapted to be inserted in the body of a receiving female connection part and includes a holding beam forming a guiding means for the connector in the body of said connection part and a pair of resilient flexible beams. The two oppositely located beams are disposed substantially perpendicularly to the holding beam, each flexible beam having a contact area, the three connection beams defining together a free entry opening. The connector also includes a bight on which are supported the three connector beams, the bight carrying the output lead of the connector.

5 Claims, 1 Drawing Sheet

FEMALE CONNECTOR WITH DUAL BEAM CONTACTS

FIELD OF THE INVENTION

This invention relates to a female connector having dual beam contacts, particularly a unitary type, adapted to be inserted into a plastic body or female receiving connector housing.

BACKGROUND OF THE INVENTION

U.S. Pat. No. 4,379,611 discloses a connector of the above-mentioned type. However, this patent provides for a guiding device for the insertion of a male contact, which has an opening and necessitates therefore a further machining step. U.S. Pat. No. 4,379,611 does not suggest any shape of the guiding device which could facilitate the handling of the connector nor any interaction between such guiding device and the contact beams of the connector. The '611 patent also does not define a predetermined bias of the contact beams before assembly, which could thereby determine a pre-established gap between the contact beams in order to assure reliability of the connector during use.

SUMMARY OF THE INVENTION

It is an object of the present invention to provide a connector wherein the deflection of the contact beams is predetermined, before assembly, and is therefore independent of the body of the male connector, in order to ensure a high contact pressure during use.

Therefore, in the female connector according to the invention, which is the above-mentioned type, the flexible contact beams are in pre-strained, resilient contact against border regions of the holding or guiding beam which is shaped so as to facilitate the handling of the female connector and the positioning, in the part thereof forming a receptacle, of the plug of a male connector.

Thereby, high contact precision is obtained after assembling, because the gap between the contact beams is pre-established and can be determined before assembly. The deflection of the flexible contact beams, which is limited by the guiding beam, is independent of the body of the male connector and the introduction of the male connector is facilitated by the controlled opening between the contact beams. Compensation of misalignment between the male and female contacts is obtained by the resiliency of the flexible contact beams. In use, the high and constant contact pressure protects against corrosion of the contact areas and provides integrity of the transmitted signal in case of impact or vibration by producing a cleaning effect by elimination of the oxides and impurities.

According to a first advantageous feature of the invention, the guiding beam has the shape of a spoon, the rounded free extremity thereof defining, with the extremities of the flexible contact beams which carry the contact areas, the entry of the male contact. Further, each flexible contact beam has on its edge, which is adjacent to the guiding beam, a protrusion which extends perpendicularly to the guiding beam and which forms a rest surface on a corresponding edge of the guiding beam.

Preferably, the female connector according to the invention is realized in a single metallic part and each contact area includes a coating layer of gold or tin.

According to another feature of the invention, one of the flexible contact beams is extended beyond the contact bight by a tinned elongate member which constitutes an output of the connector, to be soldered.

Also, a flexible contact beam may have on its external side or surface, a locking pin for the connector in the body of a female connector part.

Other features, objects and advantages of the invention will appear more clearly from the detailed description which will follow.

BRIEF DESCRIPTION OF THE DRAWINGS

In the appended drawings, given as non-limiting, illustrative examples.

DETAILED DESCRIPTION OF THE PREFERRED EMBODIMENT

Figure 1:
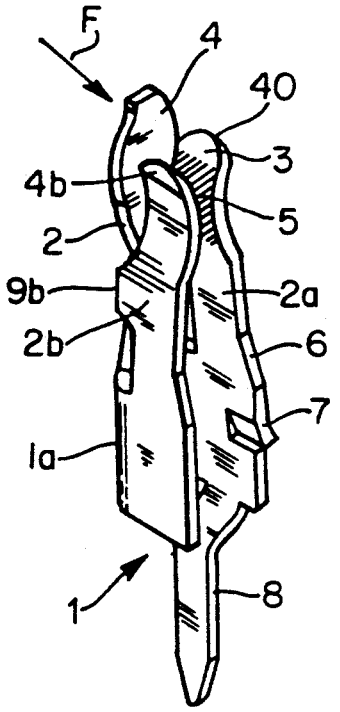
FIGS. 1 and 2 are perspective views, respectively of the inside and the outside, of a female connector according to the present invention.
Figure 2:
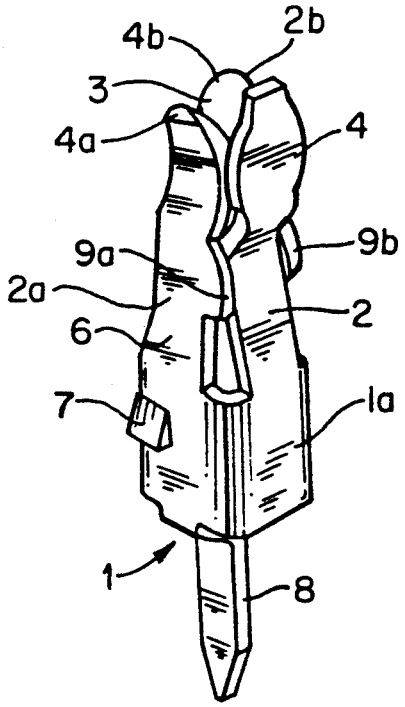
Figure 3:
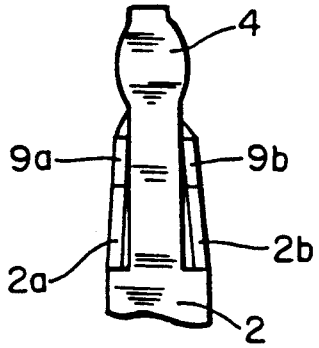
FIG. 3 is a lateral partial view along arrow F of FIG. 1.

Referring now to the drawing figures, a female connector 1 is of the dual beam contact type, in a single metallic part and forming a parallelepiped cage or box, which is opened, rugged and with rounded angles, and is intended to accept a plug of a male connector (not shown).

Connector 1 essentially includes a holding beam 2, constituting guiding means for connector 1 in the body (not shown) of a female connector part or box of plastic material, and a pair of flexible beams 2*a*, 2*b* constituting a contact member and extending each in a plane substantially perpendicular to the plane of the guiding beam 2.

Each flexible beam 2*a*, 2*b* includes a contact area 5 on the side of connector 1 where the three connector beams 2, 2*a* and 2*b* define together a broad contact entry opening 3 for the plug of the male connector.

This entry opening 3 is more particularly defined by the rounded extremity 4, having the preferred shape of a spoon, of the central beam 2, and by the curved and rounded extremity areas 4*a*, 4*b* with a convexity oriented towards the entry opening 3, of the contact beams 2*a*, 2*b*.

Each contact area 5 includes, along the greatest portion of the rounded extremities of the contact beam, a coating layer on beams 2*a*, 2*b*, of gold, which is 0.400 to 0.75 $\mu$ thick for example, or of tin.

The three connector beams 2, 2*a* and 2*b* are connected together, on the side of connector 1 by a bight 1*a*, one of the contact beams (e.g. 2*a*) being extended further than the bight by an elongate member 8 forming a tinned lead, to be soldered, of connector 1, providing a contact area in phosphor bronze, e.g. 0.2 mm thick.

One of the contact beams (e.g. 2*a*) may carry on its external side or surface a locking pin 7 for connecting the body of the female connector 1 in rigid plastic, which may include several female connectors according to the invention. This locking pin 7, which has in section the shape of a rectangular tab is shaped so as to be able to be located in a socket, having a corresponding shape, provided in the plastic connection part, so as to lock in operational position the female connector according to this invention.

In a particularly advantageous manner, it is shown in the appended figures that, on the one hand, as already described, the holding and guiding beam 2 is shaped so as to facilitate the handling of connector 1 and the positioning in such connector of a plug of a male connector and to ensure that the flexible contact bemas 2a, 2b are in preconstrained resilient rest against the rim regions of the guiding beam 2. More specifically, each flexible contact beam 2a, 2b has, on its edge adjacent to the guiding beam 2 and also adjacent to its contact area 5, an extension 9a, 9b respectively, which is directed generally perpendicularly to the surface of the guiding beam 2 and which forms a rest surface on the corresponding edge of the beam 2.

Due to the above described shape of the female connector according to the invention, the deflection of the contact beams 2a, 2b is thus pre-set, before assembly, and therefore independent of the introduction of a body of male connector, which particularly allows a high and constant contact pressure during use. Therefore high contact precision is obtained during assembly because the distance between the contact beams 2a, 2b is pre-set and may be checked before assembly. The introduction of a male connector plug or pin is further facilitated by the controlled entry opening of the contact beams, compensation for misalignment between the male and female elements being obtained due to the resiliency of the flexible contact beams 2a, 2b. During use, the high and constant contact pressure, which is obtained, prevents corrosion of the contact areas 5 and provides integrity of the signal transmitted by the connector in case of impact or vibrations, by producing a cleaning effect by elimination of the oxides and impurities.

One may also see in the drawings that flexible contact beams 2a and 2b have, between the above-mentioned extensions or protrusions 9a, 9b respectively, and the output element 8, a reinforced thickness, forming a reinforcement area 6.

According to another feature of the invention, the flexible contact beams 2a and 2b are cut before the coating step so as to constitute the contact area 5 so that the contact beams and the edge of the contact beams are therefore protected during their manufacturing.

One may also note that the deflection of the resilient beams 2a and 2b, which constitute springs, is independent of the nature and properties of the plastic material constituting the connection part or box in which is located a unitary female connector according to the invention.

This invention provides therefore a female connector of particularly reliable operation, which provides high contact connection due to its two pre-constrained integrated contact beams or blades, an excellent holding during vibration and positive locking of the contact beams in the socket of a female connection part.

Of course, different coating layers may be used for constituting the contact areas 5.

The invention is not limited to the particular embodiment which is described and illustrated herein, but is defined by the following claims wherein the reference numerals have a clarification purpose and do not limit the invention.

We claim:

1. A female connector having dual-beam contacts, adapted to be inserted in the body of a receiving female connection part, said connector (1) comprising:

a holding beam (2) forming guiding means for said connector (1) in the body of said connection part;

a pair of opposing resilient, flexible means (2a, 2b) each of said beams being disposed generally perpendicularly to the plane of the holding beam, and each opposing beam having a contact area (5) on the side of said connector (1) where three connecting means (2, 2a, 2b) define together a free entry opening (3) of said connector; and a bight (1a) on which are supported the three connector beams (2, 2a, 2b), said bight including an output lead (8) of said connector;

each flexible contact beam (2a, 2b) including on an edge adjacent said holding beam (2) a protrusion (9a, 9b) which extends generally perpendicularly to said holding beam and which forms a rest surface on a corresponding edge of the holding beam, whereby said flexible contact beams (2a, 2b) are arranged in preconstrained resilient rest against the holding beam (2) so as to facilitate the handling of the connector and the positioning in its entry opening (3) of the plug of a male connector.

2. A connector according to claim 1, wherein said holding beam (2) is shaped generally as a spoon having a rounded extremity (4) thereof defining, with extremities (4a, 4b) of flexible beams (2a, 2b) which carry the contact areas (5), the entry opening of the connector.

3. A connector according to claim 1, wherein each contact area (5) has a coating layer thereon.

4. A connector according to claim 1, wherein one of the flexible contact beams (2a, 2b) is extended beyond said bight (1a) by an elongate member (8) which forms said lead to be soldered.

5. A connector according to claim 1, wherein at least one flexible contact beam (2a, 2b) has on an outer surface a locking pin (7) for connecting said connector (1) in the body of a receiving female connection part.

* * * * *